US006190033B1

(12) United States Patent
Rickman et al.

(10) Patent No.: US 6,190,033 B1
(45) Date of Patent: Feb. 20, 2001

(54) HIGH GAS DISPERSION EFFICIENCY GLASS COATED IMPELLER

(75) Inventors: Wayne N. Rickman, Brockport; Philip E. McGrath, Victor, both of NY (US); Matthias Georg Heinzmann, Brombach (DE)

(73) Assignee: Pfaulder, Inc., Rochester, NY (US)

( * ) Notice: Under 35 U.S.C. 154(b), the term of this patent shall be extended for 0 days.

(21) Appl. No.: 09/288,929

(22) Filed: Apr. 9, 1999

(51) Int. Cl.[7] ..... B01F 7/22

(52) U.S. Cl. ..... 366/265; 366/330.3; 366/330.7; 416/241 R; 416/243

(58) Field of Search ..... 366/102–104, 366/262–265, 270, 292, 330.1, 330.3–330.5, 330.7, 342, 343; 416/234, 243, 241 R, 175, 197 R, 197 B, 198 R, DIG. 5; 261/84, 93

(56) References Cited

U.S. PATENT DOCUMENTS

| | | | | |
|---|---|---|---|---|
| Re. 35,625 | | 10/1997 | Roberts . | |
| D. 262,791 | | 1/1982 | Piarulli et al. . | |
| 1,011,259 | * | 12/1911 | Smith et al. . | |
| 1,772,521 | * | 8/1930 | Ranta . | |
| 1,940,318 | * | 12/1933 | Morse . | |
| 2,384,952 | * | 9/1945 | Miller . | |
| 3,051,072 | * | 8/1962 | Bohanon . | |
| 3,494,708 | | 2/1970 | Nunlist et al. . | |
| 3,666,242 | * | 5/1972 | Fifer . | |
| 3,775,164 | | 11/1973 | Smith et al. . | |
| 3,788,874 | | 1/1974 | Crandall et al. . | |
| 4,213,713 | | 7/1980 | Kaessner et al. . | |
| 4,221,488 | | 9/1980 | Nunlist et al. . | |
| 4,264,215 | * | 4/1981 | Nunlist et al. | 366/343 |
| 4,314,396 | | 2/1982 | Nunlist et al. . | |
| 4,365,897 | | 12/1982 | Amorese et al. . | |
| 4,508,455 | * | 4/1985 | Lerman et al. | 366/247 |
| 4,601,583 | | 7/1986 | Amorese . | |

(List continued on next page.)

FOREIGN PATENT DOCUMENTS

| | | |
|---|---|---|
| 29621683U1 | 3/1997 | (DE) . |
| 0 847 799 A1 | 6/1998 | (EP) . |
| 0 880 993 A1 | 12/1998 | (EP) . |

OTHER PUBLICATIONS

A. Bakker et al., How to Disperse Gases in Liquids, Engineering Practice, Chemical Engineering, vol. 101, No. 12, Dec. 1994, pp. 98–104.

*Primary Examiner*—Charles E. Cooley
(74) *Attorney, Agent, or Firm*—Michael L. Dunn

(57) ABSTRACT

A glass coated gas dispersing impeller. The impeller comprises a hub, having a centrally located hole. The hole has a central axis and is sized for passage over a drive shaft having an essentially vertically extending longitudinal axis so that the central axis of the centrally located hole corresponds with the longitudinal axis of the shaft. The impeller has a plurality of angles and edges, all of which have a rounded configuration. The impeller further comprising a plurality of blades secured to the hub that extend radially outward from the central axis. Each of the blades has a leading concave surface and a trailing convex surface both of which are defined by a lower edge, an upper edge, an inner edge and an outer edge. The concave surface is configured so that the upper edge overhangs the lower edge. The blades may be connected to the hub directly or by intermediate connecting means such as a disk or arm integral with the hub and extending radially outwardly from the central axis. The hub and its attached blades are covered by a contiguous coating of glass. The impeller has superior ability to disperse gas at high gas velocities without flooding when compared with known glass coated turbines.

20 Claims, 6 Drawing Sheets

U.S. PATENT DOCUMENTS 4,606,103 * 8/1986 Koehl et al. .
4,779,990 * 10/1988 Hjort et al. ..... 416/197 R
5,037,209 * 8/1991 Wyss ..... 366/343
5,156,778 * 10/1992 Small ..... 366/102
5,198,156 * 3/1993 Middleton et al. ..... 366/343
5,246,289 * 9/1993 Middleton et al. ..... 366/270
5,316,443 * 5/1994 Smith ..... 366/270
5,791,780 8/1998 Bakker .
5,904,423 * 5/1999 Forschner et al. ..... 261/93

* cited by examiner

HIGH GAS DISPERSION EFFICIENCY GLASS COATED IMPELLER

BACKGROUND OF THE INVENTION

This invention relates to corrosion resistant mixing impellers and more particularly relates to glass coated metal mixing impellers.

Glass coating of metal substrates is well known as, for example, described in U.S. Patents RE 35,625; U.S. Pat. Nos. 3,775,164 and 3,788,874. Glass coated mixing impellers are also known as, for example described in U.S. Pat. Nos. 3,494,708; 4,213,713; 4,221,488; 4,246,215; 4,314,396; 4,601,583 and D 262,791. U.S. Pat. No. 4,601,583 describes glass coated impellers fitted to a shaft by means of cryogenic cooling to obtain a very tight friction fit. The impellers are dual hub impellers, i.e. two hubs, each carrying two blades. The hubs are placed proximate each other on the shaft so that the blades are oriented 90 degrees to each other about the shaft. The patent also shows multiple impellers spaced from each other upon the shaft, known as a "dual flight" configuration.

Despite it being known that certain glass coated impellers could be placed upon a shaft, there has been no good glass coated high efficiency gas dispersion impeller available. Such a high efficiency glass coated gas dispersion impeller would be desirable to be able to quickly and efficiently assure quick gas dispersion in corrosive environments within an entire tank without concern about flooding of the impeller with supplied gas and resultant extreme drop in gas dispersing efficiency as occurs when known e.g. turbine type, impellers are used. U.S. Pat. No. 5,791,780 discloses an impeller having good gas dispersion properties but unfortunately, due to a large number of sharp angles and corners, such impellers are not suitable for glass coating for use in highly corrosive environments.

BRIEF DESCRIPTION OF THE INVENTION

In accordance with the invention it has now been discovered that an excellent gas dispersing impeller can be designed and glass coated and, if desired, be assembled in a dual hub format.

The invention therefore comprises a glass coated gas dispersing impeller. The impeller comprises a hub, having a centrally located hole. The hole has a central axis and is sized for passage over a drive shaft having an essentially vertically extending longitudinal axis so that the central axis of the centrally located hole corresponds with the longitudinal axis of the shaft. The impeller has a plurality of angles and edges, all of which have a rounded configuration. The impeller further comprising a plurality of blades secured to the hub that extend radially outward from the central axis. Each of the blades has a leading concave surface and a trailing convex surface both of which are defined by a lower edge, an upper edge, an inner edge and an outer edge. The concave surface is configured so that the upper edge overhangs the lower edge.

The blades may be connected to the hub directly or by intermediate connecting means such as a disk or arm integral with the hub and extending radially outwardly from the central axis. The hub and its attached blades are covered by a contiguous coating of glass.

DETAILED DESCRIPTION OF THE INVENTION

Figure 1:
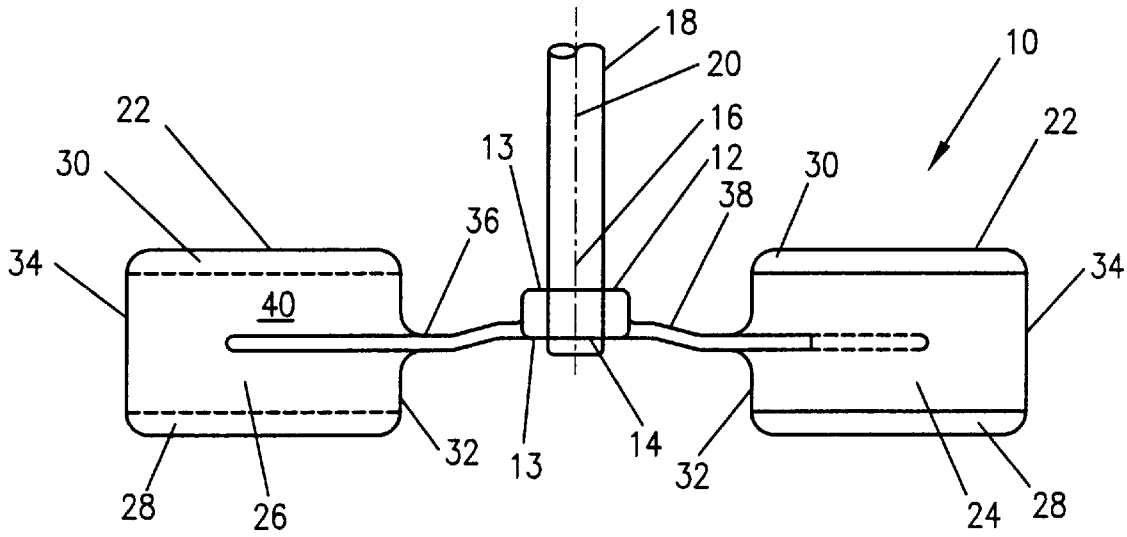
FIG. 1 shows a side view of a two bladed impeller in accordance with the invention.
Figure 2:
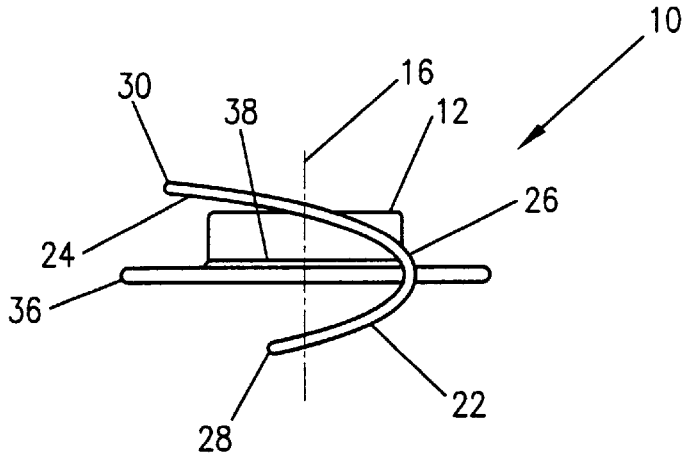
FIG. 2 shows an end view of the impeller of FIG. 1.

The impellers of the invention are glass coated by means known to those skilled in the art. In general, the metal substrate is cleaned, coated with a glass frit formulation and fired.

The impellers of the invention are usually glass coated metal. The metal is usually low carbon steel or a corrosion resistant alloy such as stainless steel. The turbine may be formed by any suitable means, e.g. by welding blades to a hub or by casting or forging the entire impeller as one piece. In all cases angles are rounded to reduce stress upon later applied glass coatings. In forming the glass coating, usually multiple glass applications are used, e.g. two ground coats followed by four cover coats.

The hub of the impeller has a hole through the center that is sized to slide over a drive shaft to form an integral mixing unit. The impeller can be retained on the shaft by friction fit or by other means such as clamping means, or screw joints.

The hub of the impeller has a hole through the center that is preferably glass coated. The surface defining the hole is preferably honed to close tolerances for friction fit to a drive shaft, e.g. by cooling the shaft cryogenically to shrink its diameter followed by sliding the hub over the shaft. Upon reheating, the shaft expands to securely hold the impeller to the shaft by friction fit to form an integral mixing unit (combined shaft and impeller).

As previously mentioned, the leading surfaces of the blades of the gas dispersing turbines of the invention have a concave configuration, i.e. the surface of the blade impinging liquid and gas, as the impeller is rotated, is behind a plane connecting the lower edge and upper edge of the blade. The concave leading surface may be formed by linear and/or curvilinear surface components. For example, the concave surface may be elliptical, parabolic, hyperbolic, or essentially formed by intersecting planes having a rounded surface at their connecting apex.

The upper edge of the blade overhangs the lower edge, i.e. a vertical plane passing through the lower edge intersects the concave surface of the blade above the lower edge at a location distally removed from the upper edge. The intersection of such a vertical plane with the concave surface of the blade is usually from about 0.1 to about 1 times the longest horizontal distance from the vertical plane to the concave surface. The overhanging portion of the concave surface of the blade is usually from about −5 to about +30 degrees from the horizontal.

The mixing unit of the invention may comprise at least two impellers, each of which is secured to the drive shaft by fit of the drive shaft through holes in the hubs of the impellers. In accordance with the invention, when multiple turbines are used, at least one of the turbines, and usually the lower turbine, is a gas dispersing turbine of the invention.

The mixing unit may, for example, comprise a combination of at least two, two bladed, gas dispersing turbines of the invention to effectively form a gas dispersing turbine having four blades. In such a case, each of the gas dispersing turbines is assembled to and secured to the drive shaft by fitting of the drive shaft through the central holes in the hubs of the turbines. The blades of a first of the gas dispersing turbines are rotated from about 30 to about 90 degrees about the longitudinal axis of the shaft, relative to orientation of the blades of a second gas dispersing turbine. Additionally, the hubs of the first and second gas dispersing turbine are proximate each other, i.e. they are directly in contact or separated by a short distance that is usually less than the thickness of a single hub. In such a configuration, the attachments of the blades of one of the impellers to the hub may be offset so that leading surfaces of the blades of both the first and second gas dispersing turbine pass through the same planes.

The invention may be better understood by reference to the drawings illustrating preferred embodiments of the invention. It is to be understood that the illustrated embodiments are for the purpose of illustrating, not limiting, the present invention.

As seen in the drawings, glass coated gas dispersing impeller 10 has a hub 12 having opposing surfaces 13. The hub 12 is provided with a centrally located hole 14 passing through surfaces 13, which hole 14 has a central axis 16. The hole 14 is sized for passage over a shaft 18 having a longitudinal axis 20 so that the central axis 16 of hole 14 corresponds with the longitudinal axis 20 of shaft 18. The impeller has at least two blades 22. Each blade 22 has a leading concave surface 24 and a trailing convex surface 26 both defined by a lower edge 28, an upper edge 30, an inner edge 32 and an outer edge 34. The concave surface 24 is configured so that the upper edge 30 overhangs the lower edge 28. The blades 22 are symmetrically attached to the hub 12 at inside edges 32 either directly or by an intermediate means such as arms 36. Arms 36 may be attached to hub 12 near one of the surfaces 13 and can be provided with an offset 38 which permits two impellers that are mirror images of each other to be mounted upon the shaft so that the blades of the impellers rotate in the same rotational planes $P_1$ to $P_n$ about the shaft. The entire impeller 10 including hub 12 and attached blades 22 are covered with a contiguous coating of glass 40. The impeller has a plurality of angles and edges, e.g. 28, 30, 32, and 34 all of which have a rounded configuration to assist in forming a durable and stable glass coating.

Figure 3:
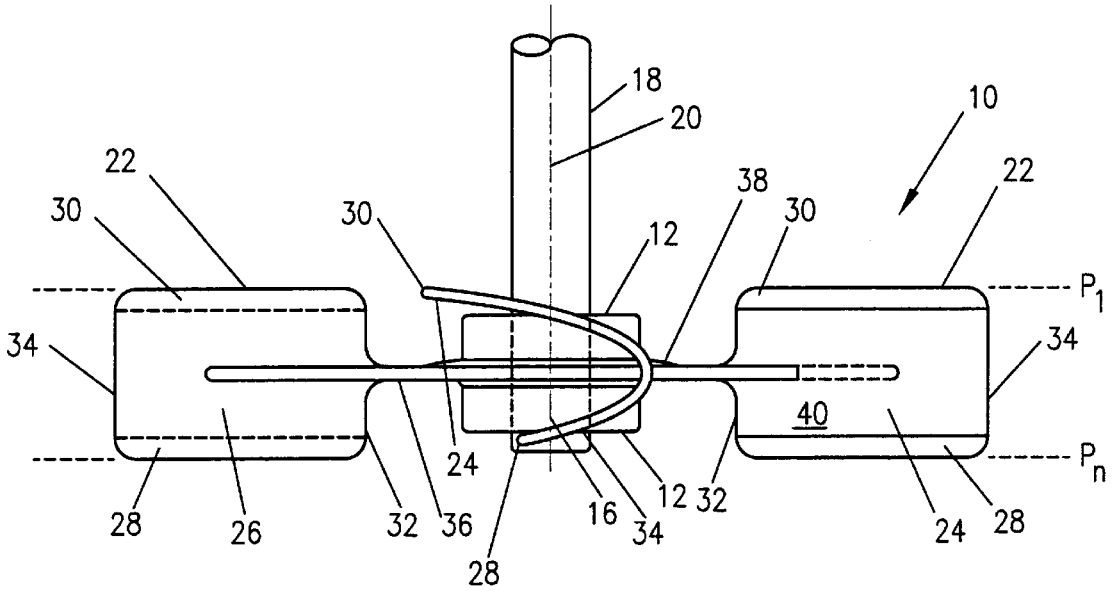
FIG. 3 shows a side view of two two bladed turbines of the invention that are mirror images of each other and have offset blades, wherein the turbines are mounted in a 90 degree orientation from each other upon a shaft so that the blades operate in the same radial planes about the shaft.
Figure 4:
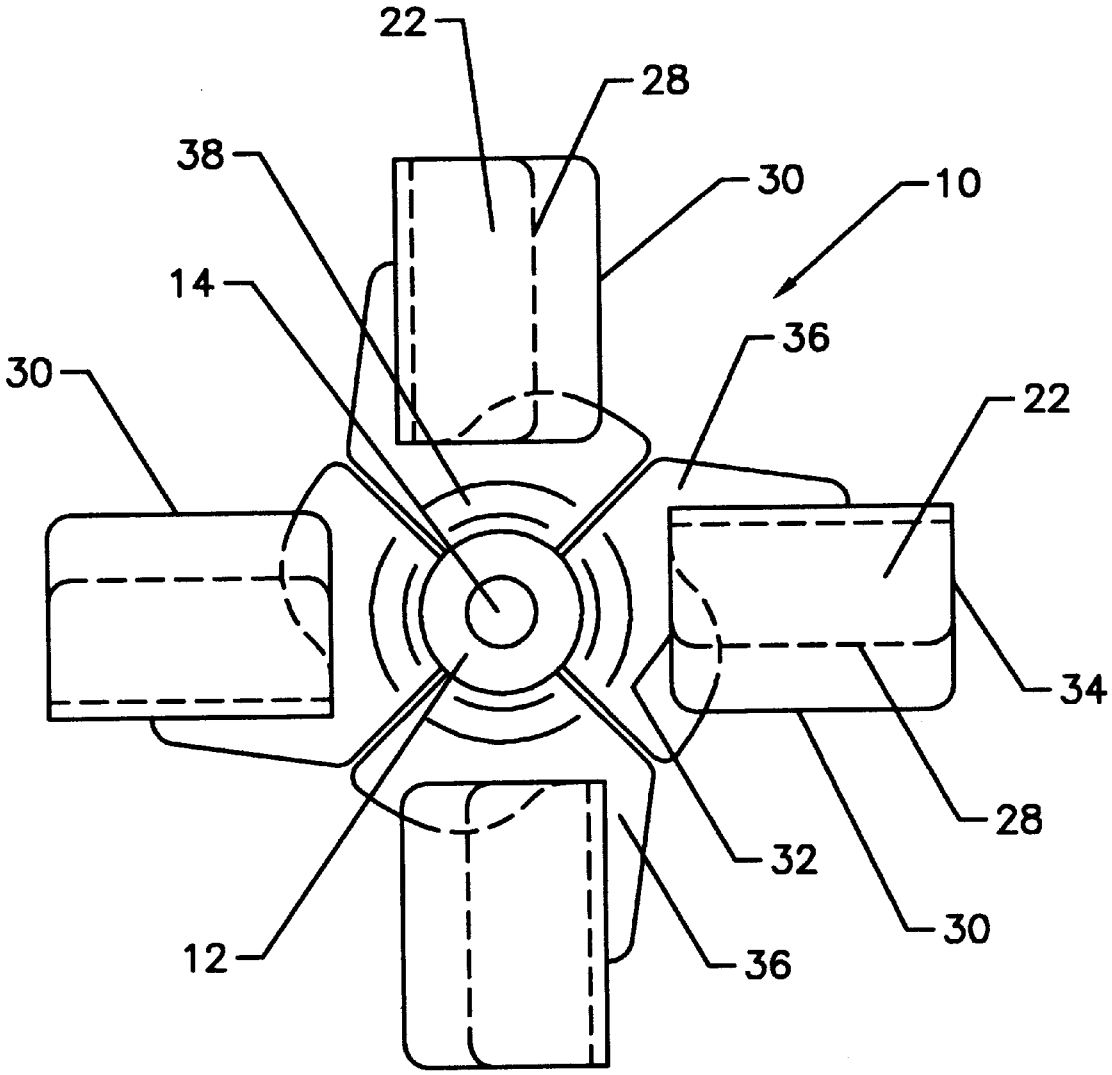
FIG. 4 shows a top view of two two bladed turbines of the invention as they would appear mounted in a 90 degree orientation from each other upon a shaft as described in FIG. 3.

As best seen in FIG. 3, at least two impellers 10 may be secured to drive shaft 18 by fit of the drive shaft through holes 14 in the hubs 12 of the impellers to form a mixing unit.

Figure 5:
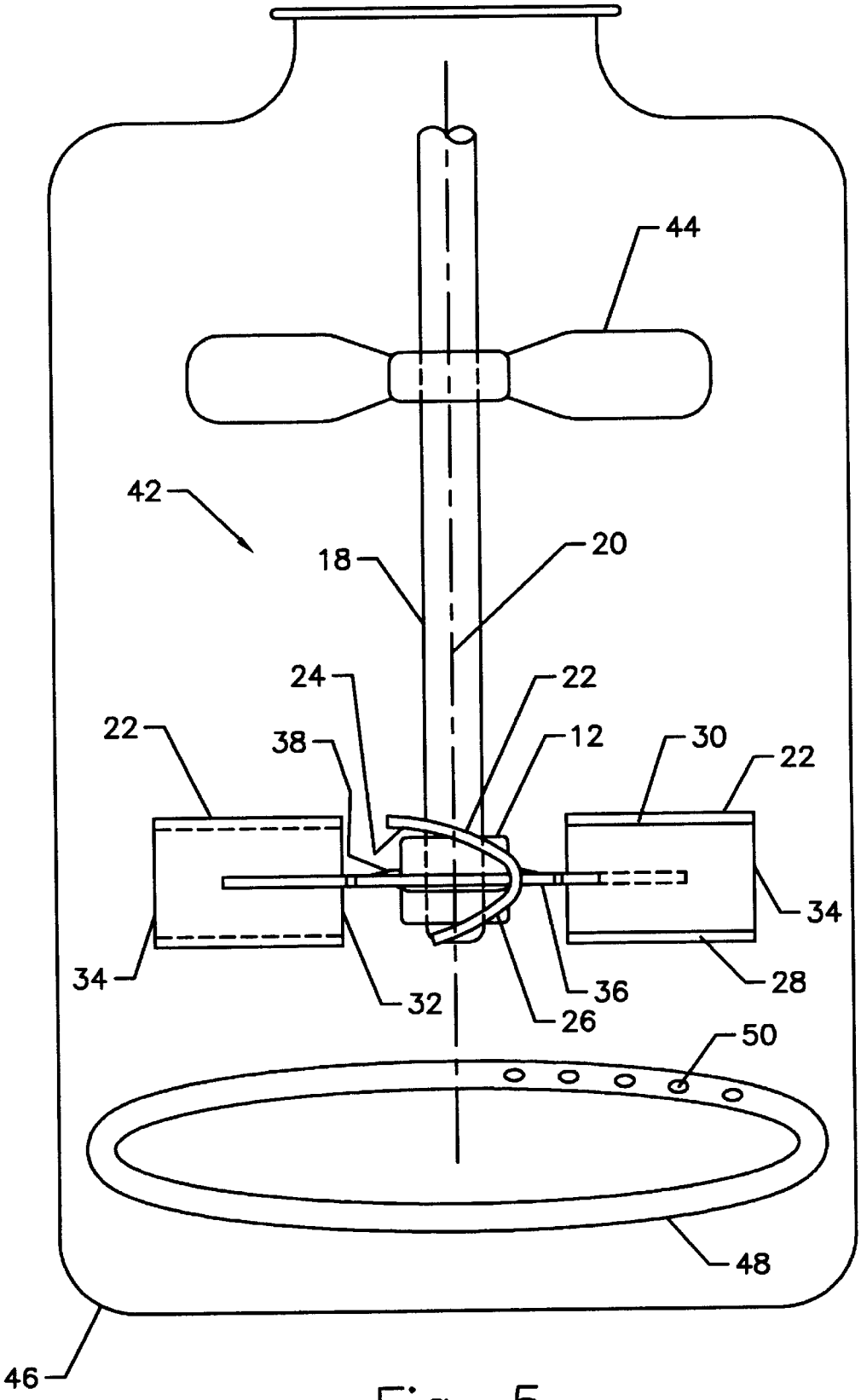
FIG. 5 shows an elevational view of a mixing unit of the invention showing two turbines of the invention mounted proximate each other on a lower portion of a shaft and a turbine type impeller mounted on an upper portion of the shaft within a tank having a sparge ring.

A mixing unit 42 may be formed as seen in FIG. 5, which comprises at least two impellers as previously described, each of which is assembled to and secured to the drive shaft 18 through central holes 14 in hubs 12 of impellers 10. In such a case the blades of a first impeller are desirably rotated from about 45 to about 90 degrees about longitudinal axis 20 of shaft 18 relative to orientation of the blades of the second impeller. The hubs of the two impellers may be proximate each other to effectively form a combination impeller having four blades. "Proximate each other", as used in this context, means that the hubs 12 of the impellers 10, are arranged so that at least a portion of the blades 22 of at least one of the impellers operates in a same rotational plane about the shaft 18 as at least a portion of the blades of the other impeller. This arrangement of multiple two bladed impellers of the invention is advantageous for several reasons. The arrangement permits effectively assembling impellers having more than two blades while permitting glassing of impellers having only two blades. Due to fewer angles in a two bladed impeller, glassing is easier to accomplish. Furthermore, the two bladed configuration permits entry into narrow tank openings typical of glass coated vessels and assembly within the vessel to form impeller assemblies effectively having more than two blades.

As seen in FIG. 5, the impellers of the invention may be combined on a shaft with other impellers that are the same or different than the impeller of the invention. The mixing unit 42 shown in FIG. 5 comprises two lower impellers 10 of the invention and an upper impeller 44 in the form of a flat blade turbine.

The glass coated gas dispersing impellers of the invention are desirably installed in a tank in conjunction with a gas supply to take advantage of the superior gas dispersing properties of the turbines of the invention. For example, as seen in FIG. 5, two, two bladed turbines of the invention, assembled on a shaft as previously described, may be installed in a tank 46 above a sparge ring 48 having gas inlet holes 50. In such a configuration, the turbines of the invention effectively disperse gas exiting from the sparge ring into surrounding liquid.

Figure 6:
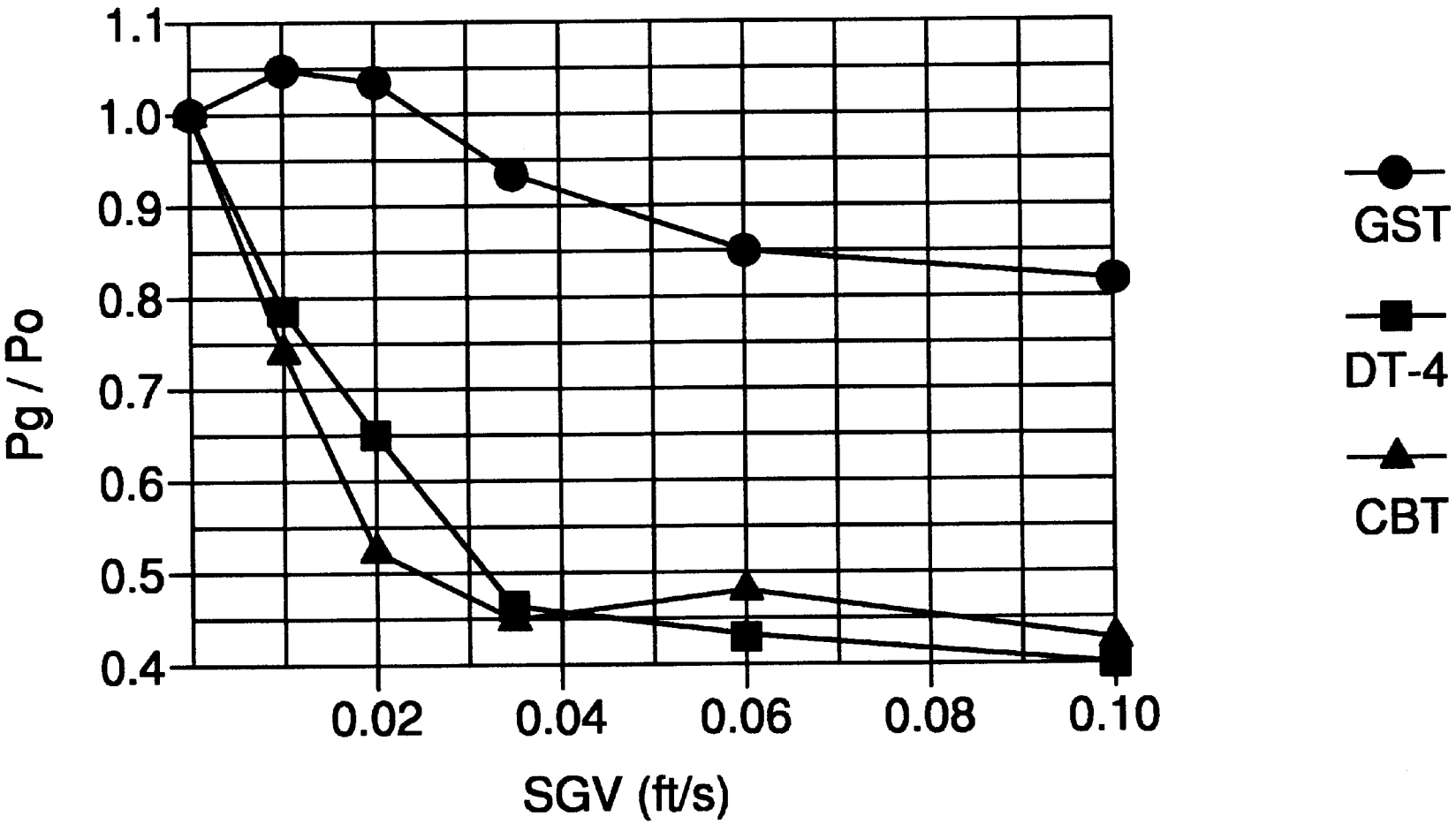
FIG. 6 shows a graph comparing power draw of the impeller of the invention at various sparging gas flows with power draw of known impellers at similar gas flows.
Figure 7:
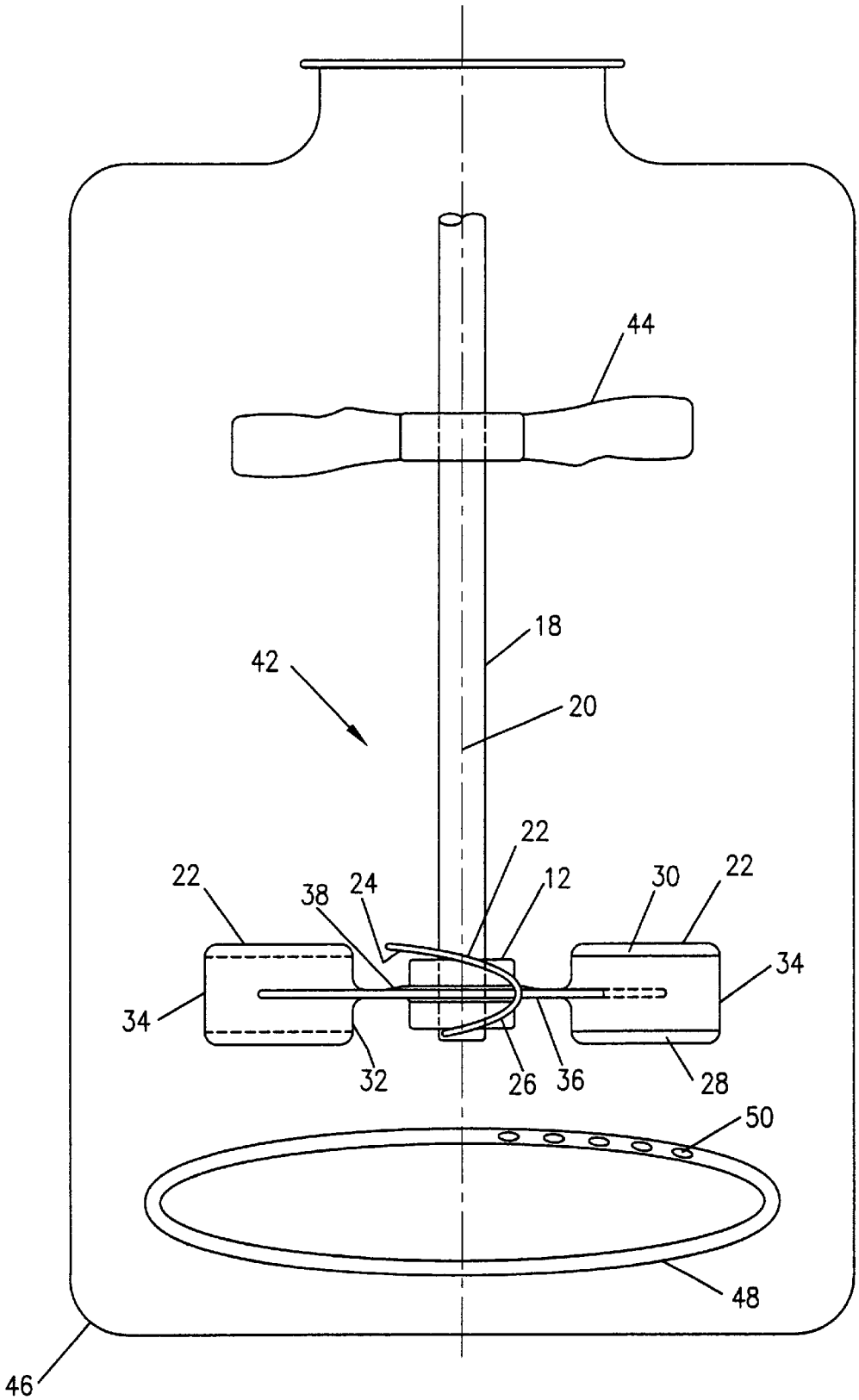
FIG. 7 shows an elevational view of a mixing unit of the invention showing two turbines of the invention mounted proximate each other on a lower portion of a shaft and a curved blade turbine type impeller mounted on an upper portion of the shaft within a tank having a sparge ring.

Impellers of the invention in a configuration essentially as shown in FIG. 3 were tested in a tank with two fin baffles to determine gas dispersing properties of the impeller by providing various flows of gas to the impeller to determine gas flooding characteristics as indicated by power drop. The results were compared with previously known glass coated impellers. The results are shown in FIG. 6. The results clearly show that the glass coated impeller of the invention (GST, gas turbine) is far superior the known glass coated curve blade turbine (CBT) and disk turbine (DT-4) impellers tested. The turbine of the invention is so far superior that, as indicated by power drop ($P_g/P_o$, gassed power/ungassed power), the CBT and DT-4 turbines flooded at superficial gas velocities (SGV) of about 0.035 feet per second (ft/s); whereas, the turbine of the invention had not yet flooded at superficial gas velocities in excess of 0.1 ft/s. This represents about three or more times the gas dispersing capability of the known glass coated turbines tested.

What is claimed is:

1. A glass coated gas dispersing impeller, said impeller comprising a hub, having a centrally located hole, said hole having a central axis, said hole being sized for passage over a drive shaft having an essentially vertically extending longitudinal axis so that the central axis of the centrally located hole corresponds with the longitudinal axis of the shaft, said impeller having a plurality of angles and edges, all of which have a rounded configuration, said impeller further comprising a plurality of blades secured to said hub and radially extending from the central axis, each of said blades having a leading concave surface and a trailing convex surface both of which are defined by a lower edge, an upper edge, an inner edge and an outer edge, said concave surface being configured so that the upper edge overhangs the lower edge.

2. The impeller of claim 1 wherein the blades are connected to the hub by means of at least one arm integral with said hub and extending radially outwardly from the central axis.

3. The impeller of claim 2 wherein the plurality of blades are two blades oppositely attached to said hub.

4. The impeller of claim 2 wherein the impeller comprises glass coated steel.

5. The impeller of claim 4 wherein the steel is a stainless steel.

6. A mixing unit comprising the impeller of claim 2 secured to the drive shaft by fit of the drive shaft through the hole in the hub.

7. The mixing unit of claim 6 wherein the impeller is secured to the drive shaft by a friction fit.

8. The mixing unit of claim 6 wherein the drive shaft comprises glass coated steel.

9. The mixing unit of claim 6 wherein the drive shaft comprises glass coated stainless steel.

10. A mixing unit comprising at least two impellers, each of which is secured to the drive shaft by fit of the drive shaft through holes in the hubs of the impellers, at least one of the impellers being an impeller as described in claim 2.

11. A mixing unit comprising a combination of at least two of the impellers, as described in claim 2, each of which is assembled to and secured to the drive shaft by fit of the drive shaft through the central holes in the hubs of the impellers, wherein the blades of a first of the two impellers are rotated from about 45 to about 90 degrees about the longitudinal axis of the shaft, relative to orientation of the blades of a second of the two impellers, the hubs of the first and second impellers being proximate each other.

12. The mixing unit of claim 11 wherein the combination of the first and second impellers has a $P_g/P_o$ (gassed power/ungassed power) of at least 0.8 at a superficial gas velocity of at least 0.1 feet per second.

13. The mixing unit of claim 11 wherein the attachments of at least two of the blades to their hub are offset so that the blades of both the first and second impellers operate in the same rotational planes about the shaft.

14. The impeller of claim 1 wherein the blades are attached to the hub by welding.

15. The impeller of claim 1 wherein the blades are attached to the hub by being integrally forged with the hub.

16. The impeller of claim 1 wherein the blades are attached to the hub by being integrally molded with the hub.

17. The impeller of claim 1 wherein the blades are attached to the hub by means of welding to an intermediate arm integral with the hub.

18. A mixing unit comprising a first impeller, as described in claim 1, mounted in a lower position on the drive shaft relative to a second impeller mounted in an upper position on the shaft so that the impellers do not rotate in a same rotational plane about the shaft.

19. The mixing unit of claim 18 wherein the second impeller is a flat blade turbine.

20. The mixing unit of claim 18 wherein the second impeller is a curved blade turbine.

* * * * *